United States Patent [19]

Ikuma

[11] Patent Number: 4,501,186

[45] Date of Patent: Feb. 26, 1985

[54] PICKUP DEVICE FOR STRINGED MUSICAL INSTRUMENT

[75] Inventor: Masahiro Ikuma, Hamakita, Japan

[73] Assignee: Nippon Gakki Seizo Kabushiki Kaisha, Hamamatsu, Japan

[21] Appl. No.: 504,497

[22] Filed: Jun. 15, 1983

[30] Foreign Application Priority Data

Jun. 21, 1982 [JP] Japan ..... 57-92637[U]
Jun. 21, 1982 [JP] Japan ..... 57-92638[U]
Jul. 6, 1982 [JP] Japan ..... 57-102190[U]

[51] Int. Cl.[3] ..... G10H 3/00

[52] U.S. Cl. ..... 84/1.16; 84/1.15; 84/DIG. 24

[58] Field of Search ..... 84/1.14, 1.15, 1.16, 84/DIG. 24

[56] References Cited

U.S. PATENT DOCUMENTS 3,454,702 7/1969 Elbrecht et al. ..... 84/1.14
4,151,776 5/1979 Stich ..... 84/1.15
4,290,331 9/1981 Izdebski ..... 84/1.14

*Primary Examiner*—Forester W. Isen
*Attorney, Agent, or Firm*—Spensley Horn Jubas & Lubitz

[57] ABSTRACT

A pickup device for an acoustic guitar having metallic strings comprises an electromagnetic pickup detachably attached in a sound hole of the guitar and a piezoelectric pickup detachably attached in the sound hole or to another part of a sound board of the guitar. Outputs of the two kinds of pickups are mixed at a selectable ratio thereby to compensate for difference in the picking-up characteristics of the respective pickups.

7 Claims, 13 Drawing Figures

PICKUP DEVICE FOR STRINGED MUSICAL INSTRUMENT

BACKGROUND OF THE INVENTION

The present invention relates to a pickup device detachably mountable on a stringed musical instrument having a sound body or resonance body capable of producing natural acoustic sounds, and more particularly to a pickup device for acoustic guitars having strings of magnetic material.

FIG. 1 of the accompanying drawings illustrates a stringed musical instrument having a hollow sound or resonance body, such as an acoustic guitar. To increase or strengthen sounds generated by such an acoustic guitar, it is frequently practiced to mount a pickup device in a sound hole 3 defined in a sound board 2 of the sound body 1, the pickup device being capable of converting vibrations of strings 4 into electric signals. It is such a pickup device readily removably attached to an acoustic stringed musical instrument that the present invention is concerned with.

One pickup device of the type described which has found practical use is shown in FIGS. 2 and 3. The pickup device is composed of a pickup mount 5 placed in a sound hole 3 in a sound board 2 and an electromagnetic pickup 6 supported on the pickup mount 5. The pickup mount 5 has support legs 7 fitted on peripheral edges of the sound hole 3, the support legs 7 being easily attachable to or detachable from the sound board 2. The electromagnetic pickup 6 is desinged so that it will be positioned directly below strings 4 when the pickup mount 5 is placed in the sound hole 3, as shonw in FIG. 3.

As is well known, the electromagnetic pickup 6 is capable of producing output electric signals in response to vibrations of the strings 4 which are made of magnetic material. The electric signals picked up are equivalent to electromotive forces developed in coils when a magnetic field generated by a magnet is fluctuated by the string vibrations. The output from the electromagnetic pickup 6 is fed over an output cord 8 to an output plug 9. The term "magnetic material" used herein means a material having a property capable of affecting a magnetic field in which the material is placed.

The electromagnetic of the foregoing type is of a low impedance and has an advantage in that it is immune to external noise. However, it has an actual response frequency band below the range of from 1 through 5 kHz, and is subjected to a poor response to the frequencies higher than the range. Where the pickup device is attached to a stringed musical instrument such as an acoustic guitar in which delicate sounds of high frequencies are of importance, sounds of the guitar as picked up by the pickup device are tend to be confined or "boxy" and less sharp, a sound quality which is far from the original sounds of the acoustic guitar and hence is quite unattractive.

To cope with this problem, there has been made an attmept to improve the high-frequency response by changing the thickness of the coil wire in the pickup and also changing the covering material itself for the coil and the thickness thereof to therby vary the capacitance between coil turns. However, the improvement achieved through these efforts has been quite unsatisfactory, and has failed to provide the sound quality of acoustic guitars sufficiently.

SUMMARY OF THE INVENTION

With the foregoing prior problems in view, it is an object of the present invention to provide a pickup device for use in a stringed musical instrument such as an acoustic guitar in which high-frequency sounds are important, the pickup device being readily attachable to and detachable from the musical instrument and cable of picking up sounds of the instrument with fidelity in a range from low to high frequencies.

The above object can be achieved according to the present invention by providing an electromagnetic pickup unit of better low-frequency characteristics and a piezoelectric pickup unit of better high-frequency characteristics, the pickup units being disposed on a pickup mount member detachably mounted on a stringed musical instrument, the arrangement being that outputs from both of the pickup units are mixed with each other.

According to another aspect of the present invention, the electromagnetic pickup unit is disposed on a member detachably mounted in a sound hole in a guitar, and the piezoelectric pickup unit is detachably mounted on a suitable member such for example as a sound board of the guitar. The pickup units produce outputs that will be mixed with each other.

According to a further aspect of the present invention, the sensitivity of the electromagnetic pickup unit varies with string groups to thereby compensate for the differences between outputs from the electromagnetic pickup unit that are caused by different string materials.

The above and other objects, features and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Figure 1:
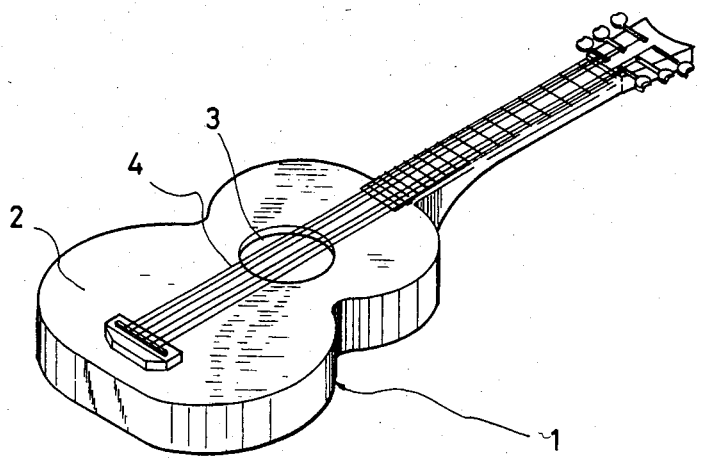
FIG. 1 is a perspective view of a guitar in which the principles of the present invention can be incorporated.
Figure 2:
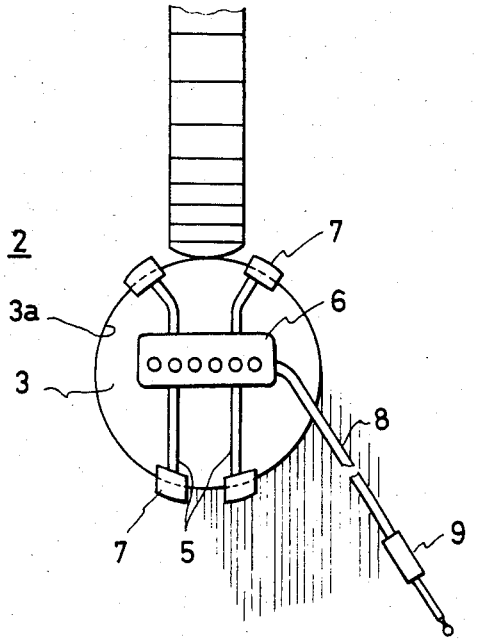
Fig. 2 Prior Art
FIGS. 2 and 3 are plan and side elevational views, respectively, of a conventional pickup device.
Figure 3:
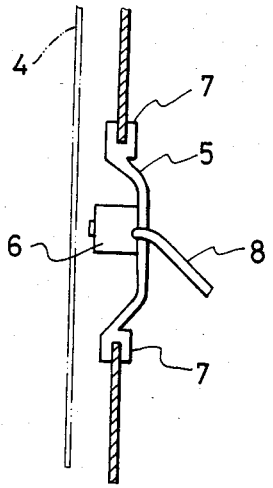
Fig. 3 Prior Art
Figure 4:
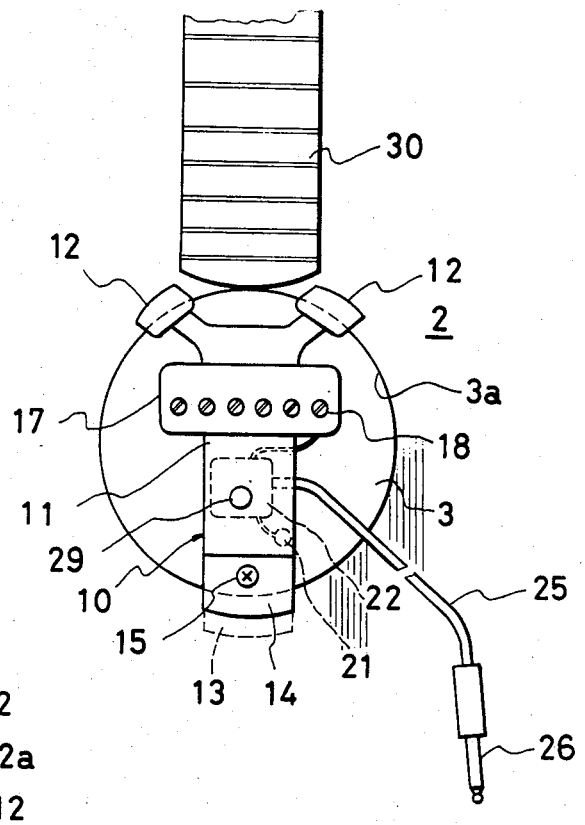
FIGS. 4 and 5 are plan and cross-sectional views, respectively, of a pickup device according to a first embodiment of the present invention.
Figure 5:
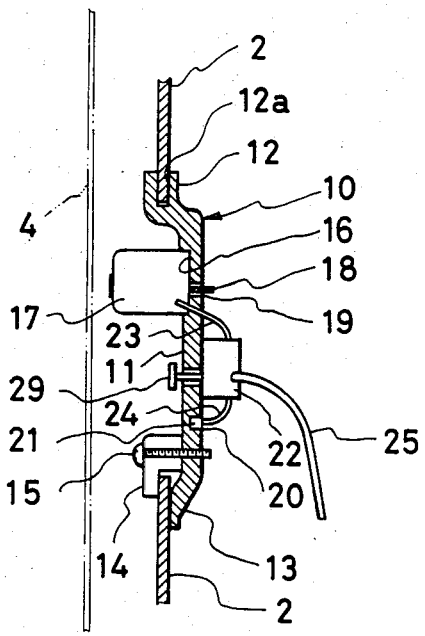

A pickup device according to a first embodiment of the present invention will be described with reference to FIGS. 4 through 6.

A flat pickup mount member 10 is made of wood, plastic, or metal and is substantially Y-shaped. The pickup mount member 10 has a central mount surface 11 slightly lower than ends thereof. The ends of the pickup mount member 10 have support legs 12, 12 and 13 detachably mounted on a peripheral edge 3*a* of a sound hole 3 defined in a sound board 2 of a stringed musical instrument such as an acoustic guitar. Thus, the pickup mount member 10 is removably mounted on the sound board 2.

The support legs 12 and 12 have horizontal slots 12*a*, respectively, in which the peripheral edge 3*a* is fitted. A hook-shaped holder 14 is fastened by a screw 15 to the pickup mount member 10 adjacent to the support leg 13. The peripheral edge 3*a* is sandwiched firmly between the support leg 13 and the hook-shaped holder 14. The pickup mount member 10 is securely mounted on the sound board 2 across the sound hole 3 by tightening the screw 15.

The central mount surface 11 of the pickup mount member 10 has a recess 16 in which an electromagnetic pickup unit 17 is fitted in place. The pickup mount member 10 has a small aperture 19 opening in the recess 16, and a screw 18 for adjusting the sensitivity of the electromagnetic pickup 17 extends through the small aperture 19.

The pickup mount member 10 also has a blind hole 20 defined in a reverse surface opposite to the central mount surface 11. A piezoelectric pickup unit 21 composed of a cylindrical piezoelectric element is housed in the blind hole 20 and securely anchored therein by an adhesive as of epoxy resin against unwanted wobbling movements.

The pickup units 17 and 21 operate on different transducer principles. More specifically, the electromagnetic pickup device 17 converts string vibrations into electric signals, while the piezoelectric pickup device 21 converts mechanical vibrations of the pickup mount member 21 into electric signals through the action of a piezoelectric element.

A preamplifier 22 is mounted on the reverse side of the pickup mount member 10 remotely from the mount surface 11 for compensating signals from the pickup units 17 and 21 for sensitivity differences, amplifying and mixing the signals from the pickup units 17 and 21. The preamplifier 22 has therein a power supply in the form of a manganese cell, mercury cell or a lithium cell. To avoid introduction of noise signals, the preamplifier 22 is positioned near the pickup units 17 and 21 and connected thereto by lead wires 23 and 24. An output plug 26 is connected to the preamplifier 22 by an output cord 25.

Figure 6:
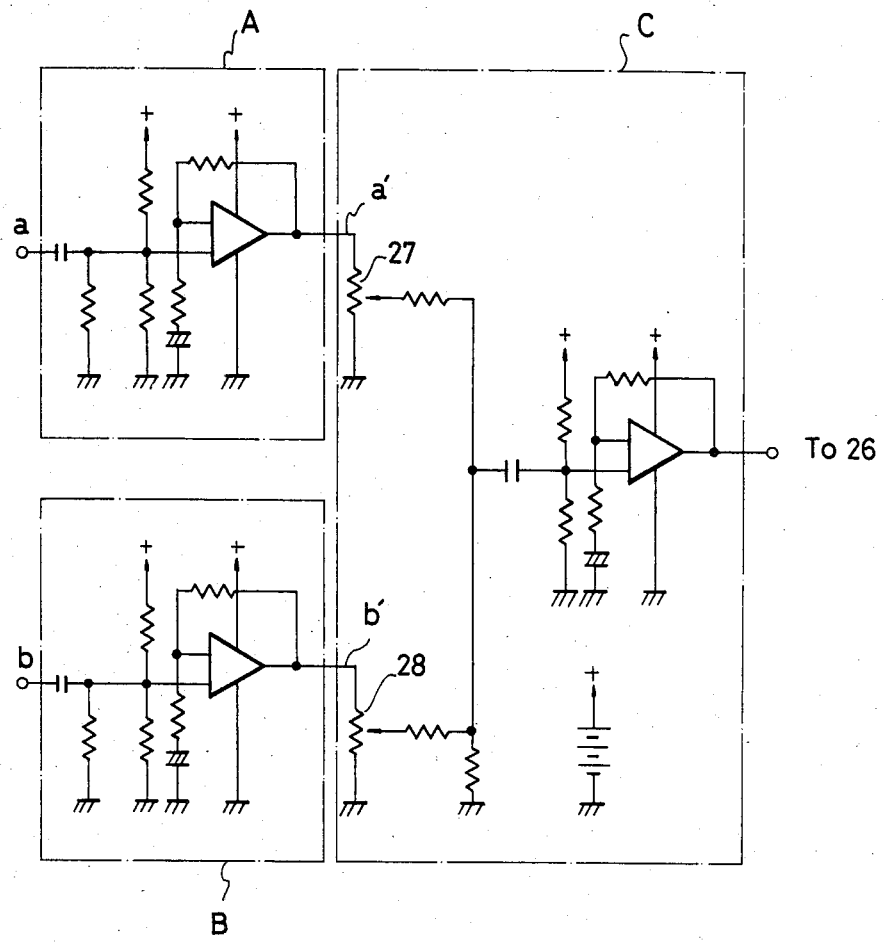
FIG. 6 is a circuit diagram of a preamplifier for use with the pickup device of the present invention.

As shown in FIG. 6, the preamplifier 22 is composed of a circuit A for amplifying an output signal a from the electromagnetic pickup unit 17, a circuit B for amplifying an output signal b from the piezoelectric pickup unit 21, and a circuit C for adjusting amplified output signals a′ and b′ from the circuits A and B, respectively, in a suitable proportion with potentiometers 27 and 28, mixing the adjusted output signals, and amplifying the mixed output signal. The circuits A, B and C have resistors and capacitors for effecting sensitivity compensation. The potentiometers 27 and 28 are composed of variable resistors for mixing the output signals a′ and b′ at a freely changeable mixing ratio. The potentiometers 27 and 28 are capable of picking up either one of the output a′ and the output b′. The potentiometers 27 and 28 are can be actuated by a knob 29 projecting on the mount surface 11 of the mount member 10. The knob 29 is manually operable by the player so that when it is turned in one direction, the output from the potentiometer 27 is increased while the output from the potentiometer 28 is reduce, and when the knob 29 is turned in the opposite direction, the output from the potentiomater 27 is reduced while the output from the potentiometer 28 is increased.

The pickup device of the foregoing construction will be attached to and used on an acoustic guitar as follows: To place the pickup device fixedly in the sound hole 3 in the guitar, the support legs 12 and 12 on the pickup mount member 10 are positioned upwardly as shown in FIG. 4 closely to a fretboard 30, and the support leg 13 is disposed downwardly, so that the electromagnetic pickup unit 17 is oriented perpendicularly to the direction in which strings 4 of a magnetic material (only shown in FIG. 5) are kept taut. The support leg 13 is first inserted into the sound hole 3, and then the slots 12*a* and 12*a* in the support legs 12 and 12 are fitted over the peripheral edge 3*a* of the sound hole 3. The holder 14 is held against the support leg 13 and the screw 15 is tightened to sandwich the peripheral edge 3*a* between the holder 14 and the support leg 13. The pickup mount member 10 is therefore fixedly mounted in position against wobbling motion. With the pickup mount member 10 thus attached in place, the electromagnetic pickup unit 17 is positioned immediately below the strings 4 as illustrated in FIG. 5.

When one or more strings 4 are played, vibrations thereof are converted by the electromagnetic pickup unit 17 into electric signals. Vibrations of the sound body which produce resonant sounds are transmitted through the sound board 2 to the pickup mount member 10 in the sound hole 3, and are then converted by the piezoelectric pickup unit 21 into electric signals. The electric signals generated by the pickup units 17 and 21 are compensated for sensitivity, adjusted for desired balancing, and mixed together by the preamplifier 22. The mixed signal is thereafter delivered as an output signal through the output plug 26. Although not shown, the output plub 26 is connected to a guitar amplifier, a mixer, an audio amplifier, or the like for converting the mixed output signal into sounds.

The electromagnetic pickup unit 17 is disadvantageous in that sounds as picked up thereby and reproduced are too confined or "boxy" and less sharp, and the piezoelectric pickup unit 21 is disadvantageous in that it reproduces too high shrieking sounds. The arrangement of the present invention however combines the advantages of the pickup units 17 and 21 while cancelling out the disadvantages thereof, with the result that the original sound quality of the acoustic guitar can be reproduced with fidelity through electric signals.

When it is desired to detach the pickup device, the support legs 12, 12 and 13 are dismounted from the sound board 2 to thereby remove the pickup mount member 10 easily from the sound hole 3. Accordingly, the acoustic guitar with the pickup device removed can be used to generate natural acoustic sounds.

While in the foregoing embodiment the pickup device has a single electromagnetic pickup unit 17 and a single piezoelectric pickup unit 21, a plurality of electromagnetic pickup units and a plurality of piezoelectric pickup units may be provided in the pickup device.

Figure 7:
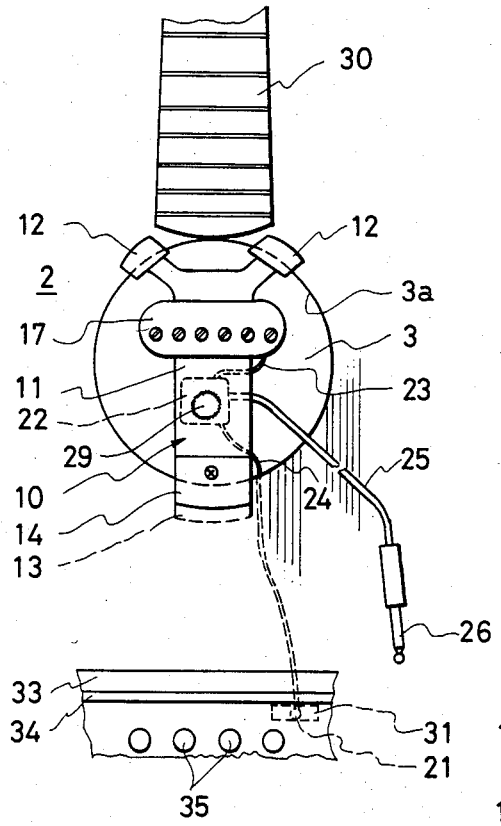
FIGS. 7 and 8 are plan and cross-sectional views, respectively, of a pickup device according to a second embodiment of the present invention.
Figure 8:
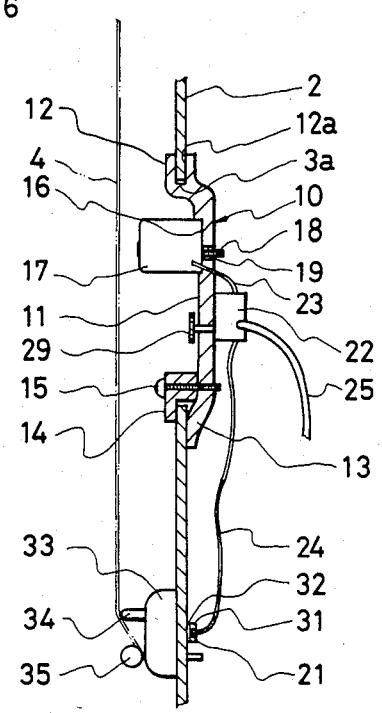

FIGS. 7 and 8 show a pickup device according to a second embodiment of the present invention. With the second embodiment, the piezoelectric pickup unit is mounted on the sound body, particularly the sound board, at a suitable position thereon, rather than on the pickup mount member in a sound hole in the sound board. Since the sound board is subjected more directly to string vibrations than the pickup mount member, the piezoelectric pickup unit mounted on the sound board serves to improve high-frequency characteristics of output signals as the piezoelectric pickup unit itself has better high-frequency characteristics. Therefore, the piezoelectric pickup unit as thus mounted lends itself to a stringed musical instrument such as an acoustic guitar which places greater importance on sounds of higher frequencies. Like or corresponding parts shown in FIGS. 7 and 8 are denoted by like or corresponding reference numerals in FIGS. 4 and 5, and will not be described in detail. Only those parts or members which are different from those of the first embodiment will be described. The piezoelectric pickup unit 21 is in the form of a cylindrical piezoelectric element housed in a block 31 of wood or plastic and secured in place therein by an adhesive such as of epoxy resin. The block 31 has an end face to which a sticky layer 32 such as an adhesive tape or a layer of rubber is applied. Thus, the block 31 can be removably attached to a musical instrument at any desired position. In the illustrated embodiment, the block 31 is attached to the back of the sound board 2 below a bridge 33 so that the piezoelectric pickup unit 21 can convert mechanical vibrations of the sound board 2 directly into electric signals. The strings 4 are kept taut on a saddle 34 mounted on the bridge 33 and fastened in place by studs 35. The piezoelectric pickup unit 21 is electrically connected by a cable 24 of a flexible material which allows the piezoelectric pickup unit 30 can be attached freely as desired, the cable 24 having a sufficient length, for example of 20 cm.

With the arrangement of the second embodiment, the electromagnetic pickup unit having better low-frequency characteristics and the piezoelectric pickup unit of better high-frequency characteristics are employed, and signals from the pickup units are mixed with each other. The electromagnetic pickup unit is mounted on the pickup mount member detachably attached to the string instrument, while the piezoelectric pickup unit is removably mounted on the sound body at an appropriate position. The pickup device can therefore be incorporated in an existing acoustic musical instrument without attaching any fixed member to the instrument. Combination of the advantages of the signals from the pickup units allows original sounds to be generated from the instrument in a wide range of from low to high frequencies. It is possible to produce sounds in favor with the player by changing the position of attachment of the piezoelectric pickup unit.

Figure 9:
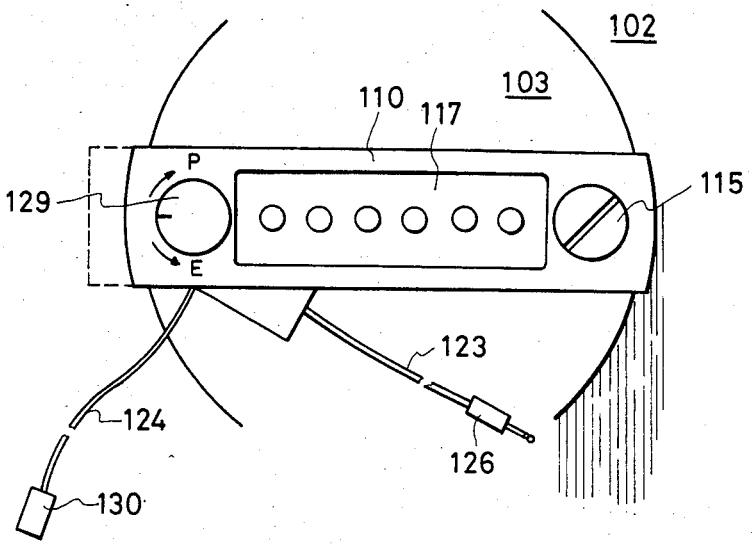
FIGS. 9 and 10 are plan and cross-sectional views, respectively, of a pickup device according to a third embodiment of the present invention.
Figure 10:
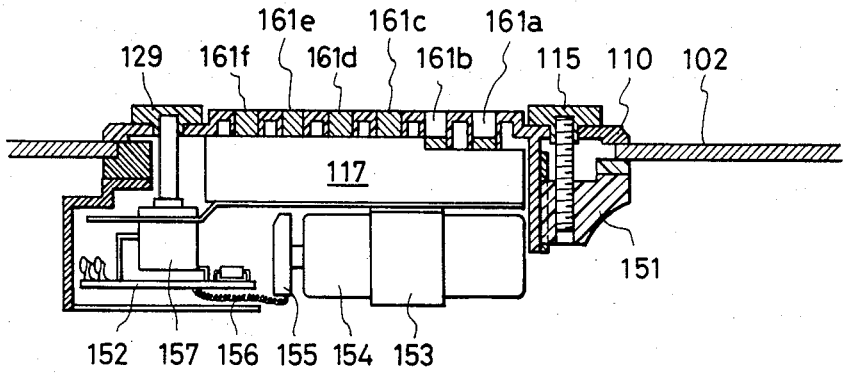

A pickup device according to a third embodiment will be described with reference to FIGS. 9 and 10. According to the third embodiment, a piezoelectric pickup unit is freely adjustable in position as in the second embodiment, and difference in output magnitude of an electromagnetic pickup unit with different strings is compensated for.

An electromagnetic pickup unit 117 is fixed to a laterally elongate pickup mount member 110 detachably mounted in a sound board 102 of an acoustic guitar by a clamp member 151 in which a screw 115 is threaded, the pickup mount member 110 extending transversely across the sound hole 103. The electromagnetic pickup unit 117 is electrically connected to a preamplifier. A piezoelectric pickup unit 130 attached to one end of a cable 124 is removably mounted in a suitable position on a guitar. The other end of the cable is connected to the preamplifier. Signals from the electromagnetic and piezoelectric pickup units 117 and 130 are mixed together and amplified by the preamplifier constructed as shown in FIG. 6 and composed of electric parts mounted on a circuit board 152. A cell 154, of the 006P type for example, serving as a power supply for the preamplifier is supported by a cell holder 153 below the electromagnetic pickup unit 117. The preamplifier is fed with an electric current from the cell 154 through a socket 155 and a lead wire 156. A variable resistor unit 157 (corresponding to the potentiometers 27 and 28 in FIG. 6) in the preamplifier is arranged on the face of the pickup mount member 110 and is operable by a balance adjustment knob 129. When the balance adjustment knob 129 is turned clockwise in the direction of the arrow P in FIG. 9, the proportion of the output from the electromagnetic pickup unit 117 is increased. When the balance adjustment knob 129 is turned counterclockwise in the direction of the arrow E in FIG. 9, the proportion of the output from the piezoelectric pickup unit 117 is increased. The output from the preamplifier is led over a cable 123 to a plug 126.

Figure 11:
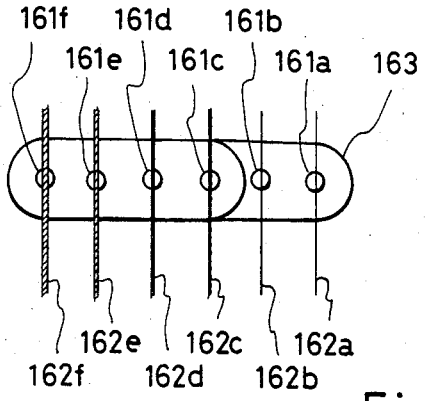
FIGS. 11 and 12 are plan and cross-sectional views of an electromagnetic pickup for use in the pickup device shown in FIGS. 9 and 10.
Figure 12:
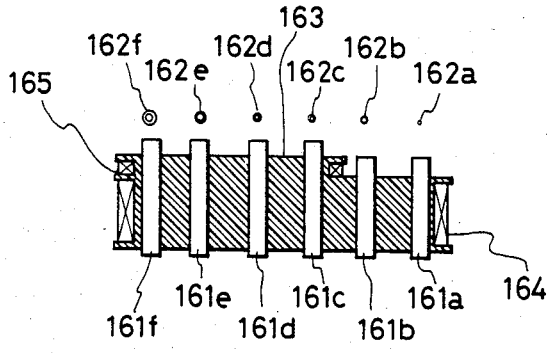

As shown in FIGS. 11 and 12, the electromagnetic pickup unit 117 has a total of six cylindrical permanent magnets 161*a* through 161*f* supported in a coil bobbin 163 made of an insulating material such as plastic, for example, and having upper ends projecting from the coil bobbin 163. The projecting ends of the permanent magnets 161*a* through 161*f* are positioned in confronting relation to first through sixth strings 162*a* through 163*f* of a guitar. The bobbin 163 carries a main coil 164 surrounding all of the magnets 161*a* through 161*f*, and an auxiliary coil 165 surrounding only the magnets 161*c* through 161*f* for the third through sixth strings, respectively. These coils 164 and 165 are vertically stacked as shown in FIG. 12 and connected in series with each other. In practice, the main coil 164 has about 4,500 turns, and the auxiliary coil 165 has about 900 turns. As illustrated in FIG. 12, the magnets 161*a* and 161*b* for the first and second strings, respectively, are shorter than the other magnets and spaced a greater distance from the strings than the other magnets. When the first string 162*a* or the second string 162*b* or both are played, an electric output is picked up only from the main coil 164. When at least one of the third string 162*c* through the sixth string 162*f* is vibrated, outputs from the main coil 164 and the auxiliary coil 165 are picked up together. With the foregoing arrangement, the electromagnetic pickup unit 117 is relatively less sensitive to the first and second strings 162*a* and 162*b*, and relatively highly sensitive to the third through sixth strings 162*c*–162*f*.

In acoustic guitars using metal strings (typically a folk guitar), the first string 162*a* and the second string 162*b* generally comprise plain or unwound strings in the form of bare strings as of iron such as piano wires, and the third thorugh sixth strings 162*c*–162*f* comprise wound strings composed of cores as of iron wound with nonmagnetic copper wires. The electromagnetic pickup unit is therefore less responsive to the wound strings. With the illustrated embodiment, however, the sensitivity of the electromagnetic pickup unit is relatively high for the third through sixth wound strings. As a result, the pickup device can produce uniform outputs when either string, wound or unwound, is played, and hence is highly preferred for use on guitars. The magnets 161*a* through 161*f* may be replaced with pole pieces of magnetic material held against a magnet or magnets. While in the foregoing embodiment, the electromagnetic pickup unit has two different sensitivities, it may have three different sensitivities. In such an alternative, it is preferable to provide two different sensitivities for the wound strings.

Figure 13:
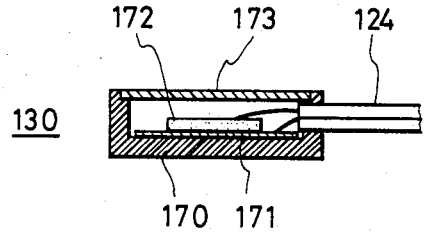
FIG. 13 is a cross-sectional view of a piezoelectric pickup for use in the pickup device illustrated in FIGS. 9 and 10.

As shown in FIG. 13, the piezoelectric pickup unit 130 is composed of a plate-like piezoelectric element 172 fixedly mounted on an electrode plate 171 bonded within a casing 170 of synthetic resin. Lead wires are connected to an upper surface of the piezoelectric element 172 and the electrode plate 171, respectively, and are led through a flexible shield cable 124 to the preamplifier. The casing 170 is hermetically sealed by a cover 173, and attached to the sound board of the guitar by a double-sided adhesive tape or a mass of putty (not shown) to enable the piezoelectric pickup element 172 to convert vibrations of the sound board due to string vibrations into electric signals. The piezoelectric pickup element 172 may comprise a bimorph cell having two piezoelectric plates.

Although certain preferred embodiments have been shown and described, it should be understood that many changes and modifications may be made therein without departing from the scope of the appended claims.

What is claimed is:

1. A pickup device in a stringed musical instrument having vibratory strings of magnetic material and a sound body carrying said strings and for transducing mechanical vibrations of said strings into electrical signals, said pickup device comprising:

a pickup mount member detachably attached to said sound body;

an electromagnetic pickup unit attached to said pickup mount member, said pickup mount member being attached to said sound body at a position whereby said electromagnetic pickup opposes said strings for electromagnetically transducing the vibrations of said strings into electrical signals;

a piezoelectric pickup unit detachably attached to said sound body at a position to receive the vibrations of said strings for piezoelectrically transducing said received vibrations of the strings into electrical signals; and mixing amplifier means attached to said pickup mount member and electrically connected to said electromagnetic pickup unit and said piezoelectric pickup unit for mixing at a selectable ratio said electrical signals from both the electromagnetic and piezoelectric pickup units, thereby providing a mixed electrical output corresponding to the mechanical vibrations of said strings, said mixing amplifier means including a single adjustment means for continuously varying the relative amplitudes of the electrical signals from said electromagnetic pickup and said piezoelectric pickup in opposite directions simultaneously.

2. A pickup device according to claim 1, further comprising a pickup mount member on which all of said electromagnetic pickup unit, said piezoelectric pickup unit and said mixing amplifier means are mounted, said pickup mount member being detachably attached to said sound body to place the electromagnetic pickup unit in the position to oppose said strings and to place said piezoelectric pickup unit in a position to receive the vibrations of the strings through said pickup mount member.

3. A pickup device according to claim 1, in which said electromagnetic pickup unit comprises a plurality of sensing members corresponding to the respective strings, said sensing members being divided into at least two groups, and means for providing said sensing members with different electromagnetic sensitivities according to the group.

4. A pickup device according to claim 3, in which said strings comprise unwound strings and wound strings, said sensing members are divided into a first group corresponding to the unwound strings and a second group corresponding to the wound strings, said sensitivity providing means provides a lower sensitivity with the first group sensing members and a higher sensitivity with the second group sensing members.

5. A pickup device in an acoustic guitar having magnetic material strings to transduce mechanical vibrations of said strings into electrical signals, said pickup device comprising:

a pickup mount member detachably attached to a sound board of said guitar across a sound hole in the sound board;

an electromagnetic pickup unit fixed to said mount member at a position to oppose said strings when the mount member is attached to the sound board for electromagnetically transducing the vibrations of said strings into first electrical signals;

a piezoelectric pickup unit detachably attached to said sound board at a position to receive the vibrations of said strings for piezoelectrically transducing said received vibrations into second electrical signals;

mixing amplifier means fixed to said mount member and connected to said electromagnetic pickup unit and said piezoelectric pickup unit for mixing and varying at a continuously selectable ratio the amplitudes of said first and second electrical signals;

flexible connecting means for electrically and mechanically connecting said piezoelectric pickup unit to said mixing amplifier means and having a certain length for permitting a certain freedom of the position where the piezoelectric pickup unit is attached; and means connected to said mixing amplifier means for outputting the mixed first and second electrical signals.

6. A pickup device according to claim 5 in which said electromagnetic pickup unit comprises a plurality of sensing members corresponding to the respective strings, said sensing members being divided into at least two groups, and means for providing said sensing members with different electromagnetic sensitivities according to the group.

7. A pickup device according to claim 5, in which said strings comprise unwound strings and wound strings, said sensing members are divided into a first group corresponding to the unwound strings and a second group corresponding to the wound strings, said sensitivity providing means provides a lower sensitivity with the first group sensing members and a higher sensitivity with the second group sensing members.

* * * * *